US005351849A

United States Patent [19]

Jagenburg et al.

[11] Patent Number: 5,351,849

[45] Date of Patent: Oct. 4, 1994

[54] CONTAINER FOR FREE-FLOWING MATERIAL

[76] Inventors: Eugene Jagenburg, 491 Hung La., Manhasset; Robert Jagenburg, 14 Valley Rd., Plandome, both of N.Y. 11030; Bruce Jagenburg, 19 Horseshoe Dr., Northport, N.Y. 11768

[21] Appl. No.: 31,239

[22] Filed: Mar. 12, 1993

[51] Int. Cl.[5] ..... B65D 90/04

[52] U.S. Cl. ..... 220/403; 220/443; 220/441; 229/23 R; 222/185; 222/181

[58] Field of Search ..... 229/23 R; 220/403, 443, 220/441; 222/185, 181

[56] References Cited

U.S. PATENT DOCUMENTS

| | | | |
|---|---|---|---|
| Re. 33,128 | 12/1989 | Nordstrom . | |
| 2,819,008 | 1/1958 | White . | |
| 2,932,438 | 4/1960 | Smith . | |
| 2,946,494 | 7/1960 | Kuss . | |
| 2,973,119 | 2/1961 | Parker . | |
| 3,108,732 | 10/1963 | Curie et al. . | |
| 3,139,227 | 6/1964 | Dorfman . | |
| 3,204,849 | 9/1965 | Vinney . | |
| 3,206,094 | 9/1965 | Humphrey . | |
| 3,880,341 | 4/1975 | Bamburg et al. | 220/443 |
| 3,952,940 | 4/1976 | Malcolm . | |
| 4,089,417 | 5/1978 | Osborne | 229/23 A |
| 4,260,071 | 4/1981 | Bamburg et al. | 220/443 |
| 4,706,809 | 11/1987 | Halsell | 229/23 A |
| 4,771,917 | 9/1988 | Heaps, Jr. et al. | 222/185 |
| 4,793,507 | 12/1988 | Delplanque . | |
| 4,815,631 | 3/1989 | Eeg et al. | 220/403 |
| 4,834,255 | 5/1989 | Boots . | |
| 4,850,506 | 7/1989 | Heaps, Jr., et al. . | |
| 4,890,787 | 1/1990 | Liebel . | |
| 4,901,885 | 2/1990 | Boots . | |
| 4,927,037 | 5/1990 | Boots . | |
| 5,050,775 | 9/1991 | Marquardt . | |
| 5,052,579 | 10/1991 | Boots . | |
| 5,069,359 | 12/1991 | Liebel . | |
| 5,071,025 | 12/1991 | Boots . | |

OTHER PUBLICATIONS

1991 Performa-Pak 55 "Set-up Sequence" Instruction sheet.
Exhibit 1 Boise Cascade's Mar. 14, 1991 design sheets.
Exhibit 2 Boise Cascade's Nov. 13, 1991 design sheets.
Exhibit 3 Boise Cascade's Jan. 13, 1992 design sheets.
Exhibit 4 Boise Cascade's Jan. 28, 1992 design sheets.
Exhibit 5 Boise Cascade's Mar. 23, 1992 design sheets.
Exhibit 6 Boise Cascade's Apr. 3, 1992 design sheets.
Exhibit 7 Boise Cascade's Jun. 20, 1987 design sheets.
Dvorak and Traub Patent application Ser. No. 07/666,297.

*Primary Examiner*—S. Castellano
*Attorney, Agent, or Firm*—Collard & Roe

[57] ABSTRACT

A container for storing free-flowing materials including an outer shell having serially connected rectangular shell panels with top flaps forming a top and bottom flaps forming a bottom. The outer shell has a rectangular cross section and includes a cut-out in a lower corner. The container also has an outer liner having an irregular octagonal cross section fitting substantially snugly within the outer shell, with an opening in the lower edge of the outer liner facing the cut-out. An inner liner has the same configuration as the outer liner and fits snugly within the outer liner. The inner liner includes top flaps at the top, bottom flaps at the bottom, and an opening adjacent the outer liner slot. Several reinforcing bands encircle the inner liner. A flexible bladder is located in the inner liner and has an inlet valve near the top and a discharge valve extending through the inner liner opening and retained by the outer liner opening. The outer shell cut-out is removable to expose the discharge valve. A base supports and elevates the flexible bladder. Top and bottom rectangular supports are located above and below the flexible bladder.

10 Claims, 3 Drawing Sheets

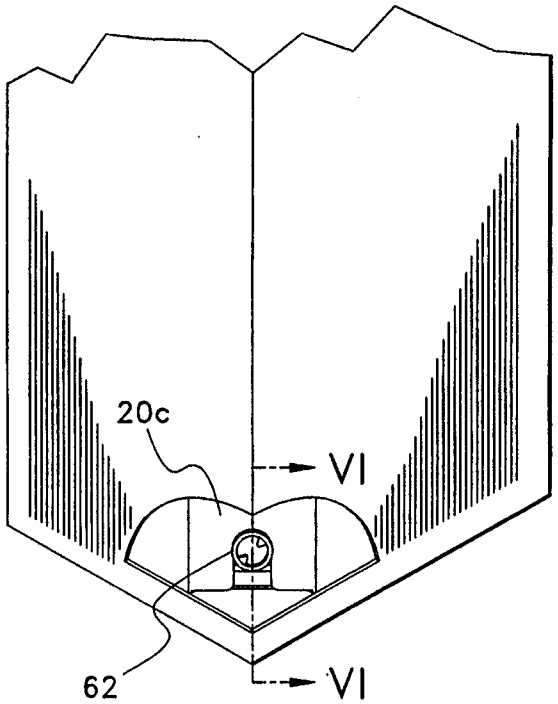
Fig. 5
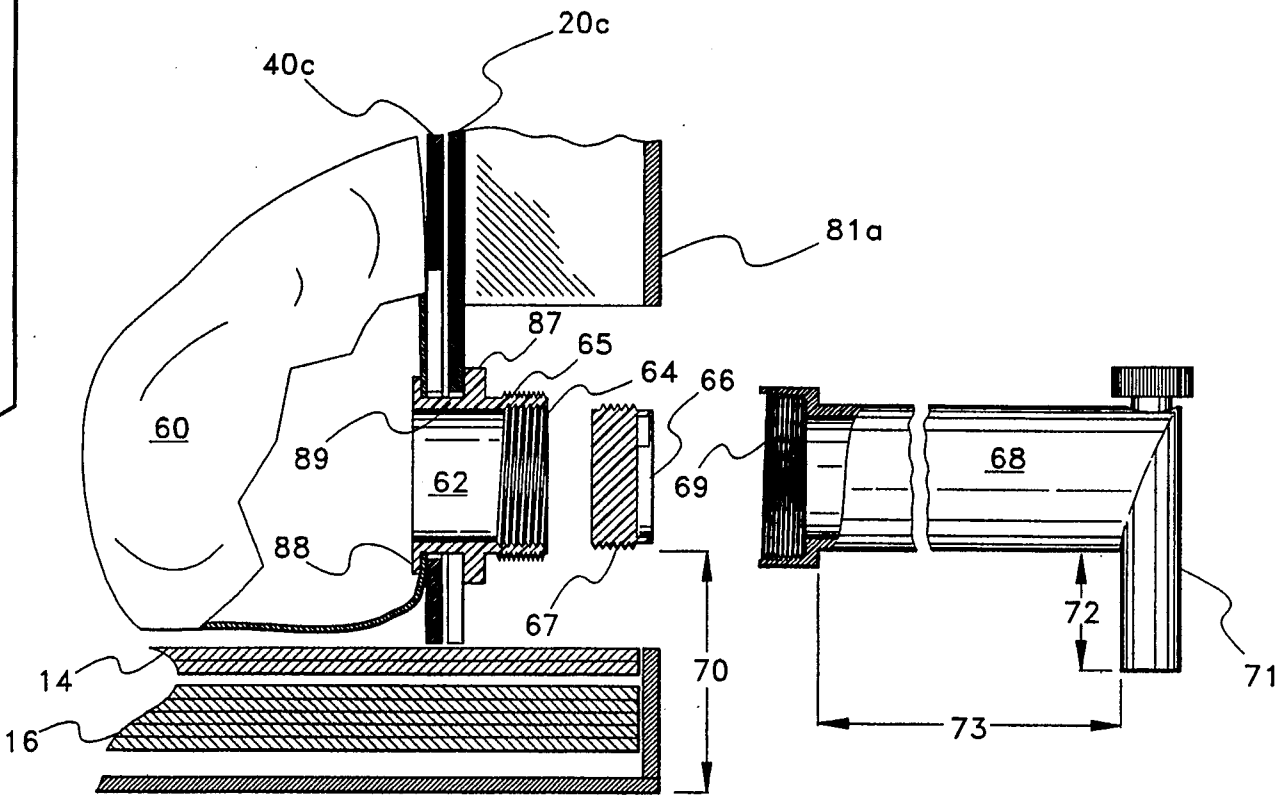
Fig. 6
Fig. 7

CONTAINER FOR FREE-FLOWING MATERIAL

BACKGROUND OF THE INVENTION

1. Field of the Invention

The present invention relates to a container for free-flowing material. More particularly, the invention relates to a container having an inner liner provided with reinforcing bands disposed within an outer shell.

2. The Prior Art

The U.S. Pat. No. 4,850,506, to Heaps, Jr. et al, discloses a container for fluent material having two inner liners, one of which is provided with pyramidal bottom forming flaps. The liners as well as the outer shell all have a similar shape and are fitted together to form a multi-layered container. A discharge fitting passes through contiguous walls in all three layers. The outer shell includes bottom flaps which are folded against the exterior of the outer shell to cover the discharge fitting. An external tension band, which holds the flaps in place, is severed to lower the flaps and access the discharge fitting.

The U.S. Pat. No. 4,834,255, to Boots, discloses a container for free-flowing materials, powders, pellets and the like, having a tubular outer envelope that can be closed at both ends and a tubular inner member which is open at both ends. The inner member is connected to the outer envelope at various positions along its circumference. The assembled container can be collapsed into a flat package for storage and shipping.

Two U.S. Pat. Nos. 4,890,787 and 5,069,359, to Liebel, disclose shipping containers having inner cylindrical members disposed within outer corrugated boxes. Both assembled containers can be flattened for storage. The '359 patent includes triangular posts between the inner member and the corners of the outer tube.

However, the prior art does not disclose a container having dual inner liners of a first configuration disposed within a shell of a different configuration. Furthermore, the prior art does not disclose a container having discharge means supported and constrained by the dual inner liners and disposed within a space formed between the dual inner liners and the outer shell. Finally, the prior art does not disclose a container having an elevated base for supporting the material within the container and facilitating removal of the material from the container.

SUMMARY OF THE INVENTION

It is therefore an object of the present invention to provide a container which overcomes the drawbacks of the prior art and provides a sturdy container for storing and shipping a large quantity of free-flowing material.

It is yet another object of the present invention to provide a container having an outer shell of a first configuration and a liner of a second configuration disposed within the outer shell.

It is still a further object of the present invention to provide a container in which the liner consists of an inner sleeve and a separate outer sleeve.

It is another object of the present invention to provide a container in which reinforcing bands encircle the inner sleeve.

It is yet a further object of the present invention to provide a container having discharge means supported and constrained by the inner sleeve and the outer sleeve and disposed within a space formed between the outer sleeve and the outer shell.

It is still another object of the present invention to provide a container with a raised base for supporting the material above the bottom of the outer shell.

It is still a further object of the present invention to provide a container which can be filled with free-flowing material from the top and emptied of such material from the bottom with facility and convenience.

It is another object of the present invention to provide a strong container which can be easily and conveniently stored when not in use.

These and other related objects are achieved according to the invention by a container for storing material including an outer shell having serially-connected shell panels. The container further includes a liner having main liner panels contiguous with the shell panels and secondary liner panels in angular relation with the main liner panels and the shell panels. Elongated spaces are formed between the secondary liner panels and the shell. At least one reinforcing band encircles the liner. An aseptic material storage device in the liner stores material. A rigid base supports the material and facilitates removal of the material from the container.

The liner consists of an inner sleeve and a separate outer sleeve having substantially the same configuration as the inner sleeve. Each of the shell panels has a top edge and a top flap at the top edge. The top flanges are foldable inwardly from the top edges toward each other to form a top of the container. Each of the shell panels has a bottom edge and a bottom flap at the bottom edge. The bottom flaps are foldable inwardly from the bottom edges toward each other to form a bottom of the container. The outer shell has a rectangular cross section and the liner has an irregular polygonal, e.g., octagonal, cross section with a plurality of main liner panels each having a determined main liner panel width greater than the width of the secondary liner panels. Each of the main liner panels of the inner sleeve has a top edge and a foldable top liner flap extending from the top edge adjacent the top and a foldable bottom flap extending from the bottom edge adjacent the bottom of the container. The top and bottom liner flaps extend through indentations in the bottom rectangular reinforcement plates and fold flat against the plates.

A flexible, preferably aseptic, bladder is located within the inner liner having an inlet valve disposed near the top of the container and a discharge valve extending through an opening in the inner liner. The outer liner has an opening which constrains movement of the discharge valve. A cut out in the outer shell is removable to expose the discharge valve. A base having several layers elevates the flexible bladder and discharge valve to facilitate the placement of a discharge fitting on the discharge valve. The bottom flaps of the inner liner are folded beneath the bottom rectangular plate and base and above the container bottom.

The invention further comprises a structure for producing a container having an outer shell blank with outer shell panels in serial array and end panels that are joined together to form a first continuous wall structure. The outer shell blank has a top flap and a bottom flap connected to each outer shell panel. Two of the adjacent shell panels include a band of perforations defining a singular cut-out. An outer sleeve blank has outer sleeve panels in serial array and outer sleeve end panels that are joined together to form a second continuous wall structure snugly locatable within the first continuous wall structure. One of the outer sleeve panels includes a slot for placement adjacent to the cut-out. An inner sleeve blank has inner sleeve panels and inner sleeve end panels that are joined together to form a third continuous wall structure snugly locatable within the second continuous wall structure. The inner sleeve end panels are located opposite the outer sleeve end panels. One of the inner sleeve panels includes an opening for placement adjacent to the slot. The inner sleeve blank further includes an upper flap and a lower flap connected to selected inner sleeve panels corresponding to the outer shell panels. A plurality of parallel reinforcing bands are coupled to the inner sleeve blank.

BRIEF DESCRIPTION OF THE DRAWINGS

Other objects and features of the present invention will become apparent from the following detailed description considered in connection with the accompanying drawings that disclose an embodiment of the present invention. It should be understood, however, that the drawings are designed for the purpose of illustration only and not as a definition of the limits of the invention.

In the drawings, wherein similar reference characters denote similar elements throughout the several views:

FIG. 5 is a perspective view, on an enlarged scale, of a lower corner of the outer container with the cut-out removed, showing the discharge valve;

FIG. 6 is a partly cross-sectional view, on an enlarged scale, taken along lines VI—VI of FIG. 5 illustrating the cooperative retention of the discharge valve by the inner and outer sleeves; and FIG. 7 is a side-elevational view, in part cross section, showing a fitting for coupling to the discharge valve.

DETAILED DESCRIPTION OF THE PREFERRED EMBODIMENT

Figure 1:
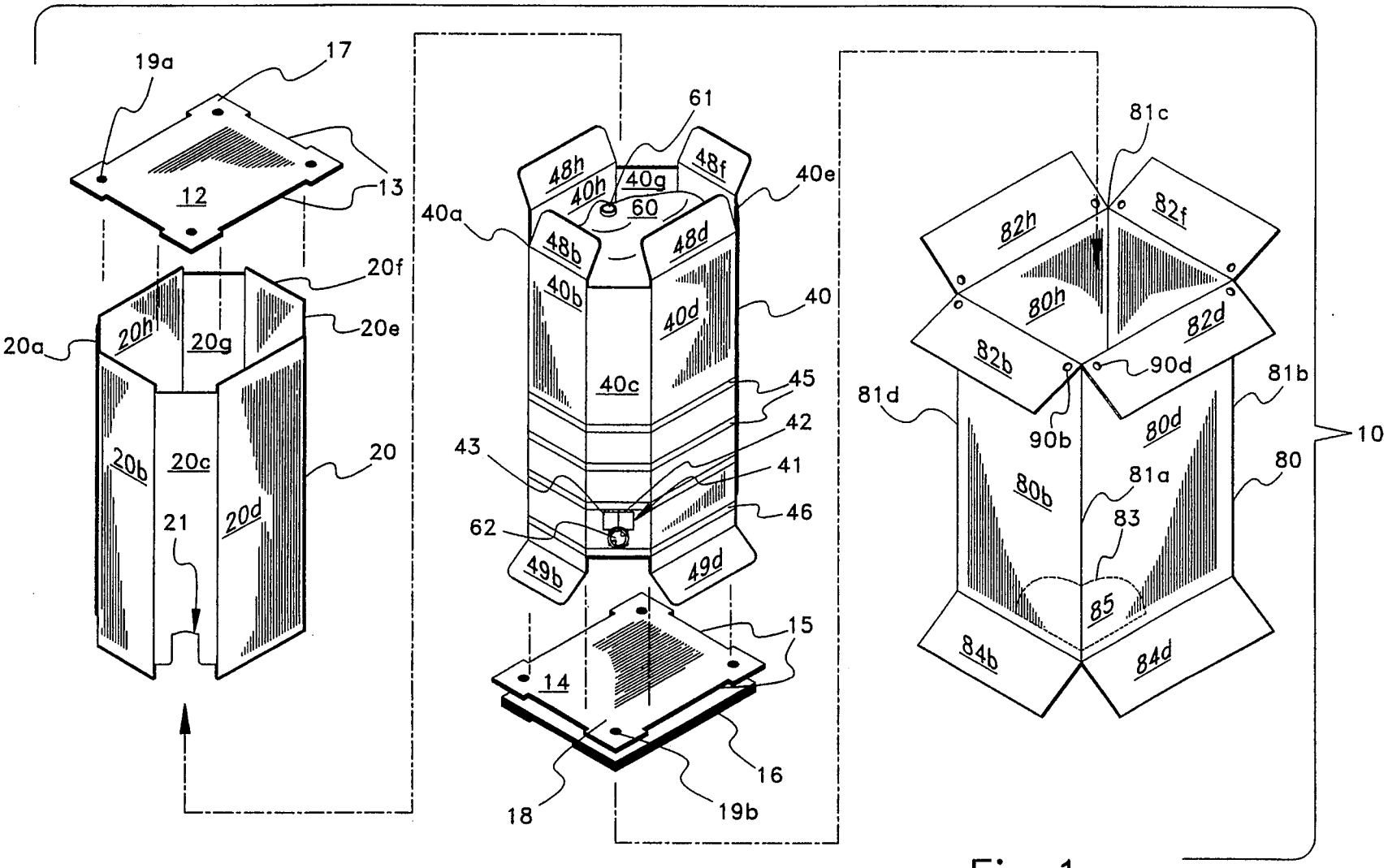
FIG. 1 is an exploded view of a container for free-flowing material according to the invention.

Referring now in detail to the drawings and, in particular, FIG. 1, there is shown a container 10 including an outer sleeve 20 having an opening 21 opening from a bottom edge thereof. Outer sleeve 20 is formed as an irregular octagon, for example, and fits substantially snugly over an inner sleeve 40. Inner sleeve 40 contains a flexible bladder 60 which includes an inlet valve 61 at the upper top end of said flexible bladder and a discharge valve 62 at the bottom side of said flexible bladder 60. Discharge valve 62 extends outwardly through a generally T-shaped opening 41. Two gates 42 and 43 extend across the upper horizontal portion of opening 41. Gates 42 and 43 are hinged to open outwardly and admit discharge valve 62 through the space usually occupied by the closed gates 42 and 43. Discharge valve 62 is supported in the base of T-shaped opening 41. Gates 42 and 43 are subsequently forced closed over an annular collar on the external side of discharge valve 62. In this manner, discharge valve 62 is held in place during filling of flexible bladder 60. Opening 21 of outer sleeve 20 is then wedged downward between the annular collar and inner sleeve 40 to further constrain discharge valve 62. Several upper reinforcement bands 45 encircle inner sleeve 40 above discharge valve 62 and opening 41. A lower reinforcement band 46 encircles inner sleeve 40 below discharge valve 62 and opening 41.

An upper plate 12 is placed over outer sleeve 20 and inner sleeve 40. Top flaps **48*b*, 48*d*, 48*f* and 48*h* of inner sleeve 40 extend upwardly through indentations 13 formed in the sides of an upper reinforcement plate 12. Top flaps 48*b*, 48*d*, 48*f* and 48*h* are then folded inwardly against a top surface of upper plate 12. Bottom flaps 49*b*, 49*d*, 49*f* and 49*h*, of which 49*f* and 49*h* are not seen in the view shown, extend downwardly through indentations 15 formed in the sides of a lower reinforcement plate 14. An additional base 16 is placed underneath lower plate 14 to support flexible bladder 60 at a distance above the bottom of container 10. Flaps 49*b*, 49*d*, 49*f* and 49*h* fold inwardly toward each other and lie adjacent a bottom surface of base 16. Plates 12 and 13 are provided with holes 19*a* and 19*b***, respectively, in each corner.

The entire assembly consisting of upper plate 12, outer sleeve 20, flexible bladder 60, inner sleeve 40, lower plate 14 and base 16 is placed within outer container or outer shell 80. Outer sleeve 20 is not laminated to outer shell 80. Discharge valve 62 faces a corner **81*a* of outer container 80. Top flaps 82*b*, 82*d*, 82*f* and 82*h* fold inwardly toward each other to form a top of container 10. Top flaps 82*b*, 82*d*, 82*f* and 82*h* each include two holes 90*b*, 90*d*, 90*f* and 90*h* which overlie holes 19*a* when flaps 82 are closed. These holes 19*a* and 90** serve as vent holes to cool the container contents. In addition, dolly pins may be placed into these holes to facilitate moving the container.

Bottom flaps **84*b*, 84*d*, 84*f* and 84*h*, of which 84*f* and 84*h* are not seen in the view shown, fold inwardly to form a bottom of container 10. Top flap 48*b* and bottom flap 49*b* have fold lines which are both parallel to the fold lines of top flap 82*b* and bottom flap 84*b***. Similarly, designated flaps, i.e. "*d*" flaps, "*f*" flaps and "*h*" flaps, all have fold lines which are parallel to each other. A continuous perforation 83 spans both panels **80*b* and 80*d* across corner 81*a*. Perforation 83 defines a singular cut-out 85 which can be removed from outer shell 80 to expose discharge valve 62 and panel 20*c* of outer sleeve 20**.

Outer sleeve 20 and inner sleeve 40 are irregular octagons having sides designated "*b*", "*d*", "*f*" and "*h*" which are generally much wider than the sides designated "*a*", "*c*", "*e*" and "*g*". These wider sides **20*b*, 20*d*, 20*f* and 20*h*, and 40*b*, 40*d*, 40*f* and 40*h*, rest flat against sides 80*b*, 80*d*, 80*f* and 80*h* of outer container 80. Thus, the majority of support for flexible bladder 60** is provided by the "*b*", "*d*", "*f*" and "*h*" panels. The narrower sides of outer sleeve 20 and inner sleeve 40 designated "*a*", "*c*", "*e*" and "*g*" diagonally face each of the corners **81*a*, 81*b*, 81*c* and 81*d* of outer container 80. This configuration reduces stress on corners 81**, since no stress is directed to the corner. Panels "*b*", "*d*", "*f*" and "*h*" are two times as wide or wider than panels "*a*", "*c*", "*e*" and "*g*".

A triangular space is formed between the narrower panels and the corners, for example, panel **20*c* and corner 81*a*. It should be noted that outer sleeve 20 and inner sleeve 40 could also be constructed as different cross-sectional polyhedrons, for example, cylinders having a pentagonal cross section, a hexagonal cross section, or a septagonal cross section. In the pentagonal configuration, a single triangular space would exist between panel 20***c*, 80*b* and 80*d* at corner 81*a*. Additional triangular shaped corner spaces could be optionally provided at corners 81*b*, 81*c* and 81*d* and are in the illustrated embodiment.

Figure 2:
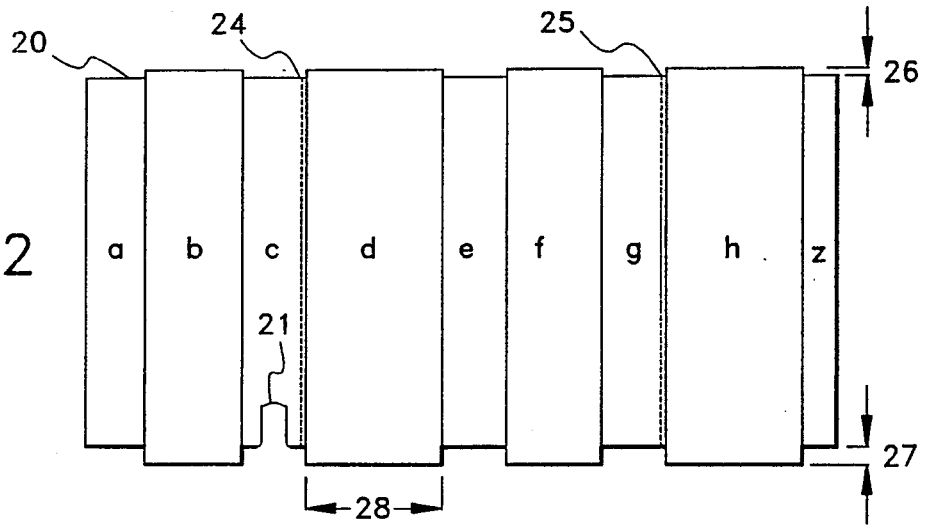
FIG. 2 is a top plan view of a blank for forming the outer sleeve of the container.
Figure 3:
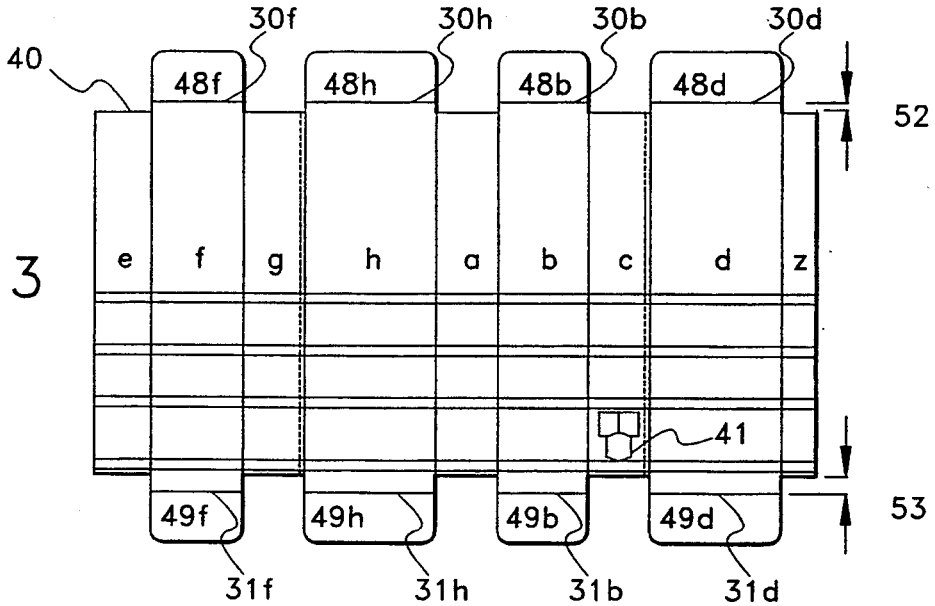
FIG. 3 is a top plan view of a blank for forming the inner sleeve of the container.
Figure 4:
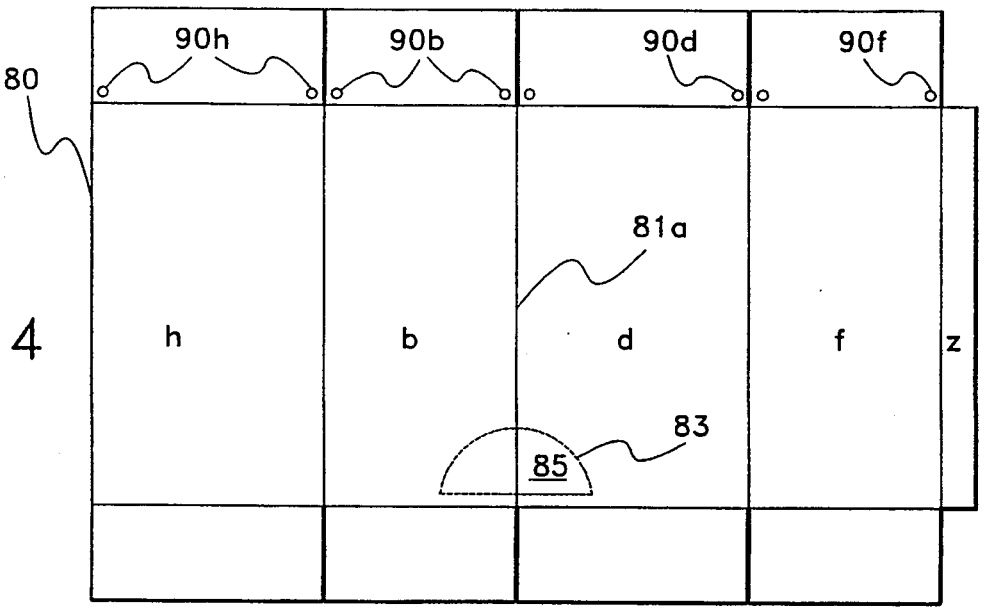
FIG. 4 is a top plan view of a blank with a cut-out for forming the outer shell of the container.

Referring now to FIGS. 2, 3 and 4, there is shown three flat blanks which can be erected to form outer sleeve 20, inner sleeve 40 and outer container 80. Although outer sleeve 20 is shown with eight panels 20*a* through 20*h*, there can be as few as five panels to form a pentagonal cylinder, as discussed previously. An end flap 20*z* is provided which can be adhered to panel 20*a* to erect outer sleeve 20. When erected outer sleeve 20 includes four opposed side walls, i.e., 20*b* and 20*d*; 20*f* and 20*h*, and four opposed corner walls, i.e., 20*a* and 20*c*; 20*e* and 20*g*. Fold lines 24 and 25 permit erected outer sleeve 20 to be folded flat for shipping empty containers. The erected outer sleeve 20 would be folded in half with panels 20*d*, 20*e*, 20*f* and 20*g* lying flat against panels 20*a*, 20*b*, 20*c* and 20*h*.

The top of panels 20*b*, 20*d*, 20*f* and 20*h* extends a distance 26 above the top of panels 20*a*, 20*c*, 20*e* and 20*g*.

Top distance 26 corresponds to the thickness of upper plate 12. Panels 20*b*, 20*d*, 20*f* and 20*h* have a width 28 which is approximately equal to the width of recesses 13 in the sides of upper plate 12. Upper plate 12 additionally includes diamond-shaped corners which extend above panels 20*a*, 20*c*, 20*e* and 20*g* into corners 81. The bottom portion of panels "*b*", "*d*", "*f*" and "*h*" extends a bottom distance 27 beyond the bottom of panels 20*a*, 20*c*, 20*e* and 20*g*. Bottom distance 27 corresponds to the thickness of lower plate 14 and base 16. Lower plate 14 also includes diamond-shaped corners 18 which extend underneath panels 20*a*, 20*c*, 20*e* and 20*g* into corners 81. Upper plate 12 and lower page 14 are similarly shaped.

FIG. 3 shows that the upper fold lines 30*f*, 30*h*, 30*b* and 30*d* of panels 40*f*, 40*h*, 40*b* and 40*d*, respectively, extend a top distance 52 beyond the upper edge of panels 40*e*, 40*g*, 40*a* and 40*c*. Top distance 52 is approximately equal to the thickness of upper plate 12, so that upper flaps 48*f*, 48*h*, 48*b* and 48*d* can be folded inwardly towards each other at right angles to lie flat on the top side of upper plate 12. Erected inner sleeve 40 includes four opposed side walls, i.e., 40*f* and 40*h*; 40*b* and 40*d*, and four opposed corner walls, i.e., 40*e* and 40*g*; 40*a* and 40*c*.

The lower fold lines 31*f*, 31*h*, 31*b* and 31*d* of panels 40*f*, 40*h*, 40*b* and 40*d*, respectively, extend a bottom distance 53 beyond the bottom edge of panels 40*e*, 40*g*, 40*a* and 40*c*. Bottom distance 53 corresponds to the thickness of lower plate 14 and base 16. Lower flaps 49*f*, 49*h*, 49*b* and 49*d* can therefore be folded inwardly at right angles to lie flat along the bottom surface of base 16.

Plates 12 and 14 keep inner sleeve 40, outer sleeve 20 and outer shell 80 aligned with each other and prevent the container from deforming, which may occur due to sloshing of the contents during shipment. The upper and lower ends of inner sleeve 40 and outer sleeve 20 are secured in indentations 13 and 15 and restrained from sliding toward corners 81 of outer shell 80. Also, since the corners of plates 12 and 14 extend to corners 81, outer shell 80 is prevented from deforming, i.e., deforming from a rectangular cross section to a parallelogram-shaped cross section.

Inner sleeve 40 is erected by adhering flap 40*z* to either the internal or external side of flap 40*e*. It should be noted that the joint for inner sleeve 40 occurs between panels "*d*" and "*e*". In the completed container this joint is located between panels 20*d* and 20*e* which is the center of the blank from FIG. 2. Outer sleeve 20 is erected by adhering panel 20*z* to the inner or outer surface of panel 20*a*. This joint which occurs between panels "*h*" and "*a*" is located in the center of the blank shown in FIG. 3. The distance between the top and bottom fold lines of panels 40*f*, 40*h*, 40*b* and 40*d* is approximately equal to the distance between the top and bottom of the outer container 80. Since inner sleeve 40 nd outer sleeve 20 fill the entire height of outer container 80, outer container 80 is prevented from tilting deformations, e.g., due to shifts in weight during shipping.

The letter designation in FIGS. 2, 3 and 4 are used to determine which panels are contiguous with each other. For example, panel 20*c* with slot 21 overlies panel 40*c* which contains opening 41. Panel 20*b* is located between panel 40*b* and 80*b*. Similarly, panels 20*d*, 20*f* and 20*h* are located between panels 40*d*, 40*f* and 40*h* and panels 80*d*, 80*f* and 80*h*. Panels 20*c* and 40*c* face corner 81*a* and cut out 85.

As can be seen in FIG. 5, cut out 85 is removed revealing panel 20*c* and discharge valve 62. FIG. 6 shows valve 62 with a rigid external collar 87 and a rigid internal collar 88. The distance between collars 87 and 88 defines a throat 89 which is slightly longer than the combined thickness of panels 40*c* and 20*c*. Panels 40*c* and 20*c* are wedged between collars 87 and 88 to support discharge valve 62 and maintain it in a horizontal orientation during filling, shipment and discharge of the material. External collar 87 may be oriented parallel to internal collar 88.

FIGS. 6 and 7 show discharge valve 62 with concentric internal threads 64 and external threads 65. A plug 66 includes external threads 67 for cooperatively engaging internal thread 64. Plugs 66 caps discharge value 62 for shipment. A fitting 68 is shown having internal threads 69 for cooperatively engaging external threads 65 after plug 66 is removed. The bottom of discharge valve 62 is located a distance 70 from the bottom of container 10 due to the inclusion of lower plate 14 and base 16 underneath flexible bladder 60. Fitting 68 has a spout 71 with an offset 72. Since offset 72 is significantly shorter than distance 70, fitting 68 can be easily threaded onto external threads 65 with spout 71 having clearance with the surface supporting the container. The main body of fittings 68 extends a distance 73 to allow spout 71 to clear the corner 81*a* of container 10.

The container described therein has been commercially manufacture as a 55 gallon bottom unloading aseptic bin suitable for shipping any liquid, slurry or paste-like material. The container is ideal for users who cannot handle large respective bulk bottom loaders which have a standard size of about 220 gallons, or more. Since the 55 gallon bin is over 75% smaller than 220 gallons bulk bin, it is much easier to handle and store than the larger bulk bins. Furthermore, four-55 gallon bins can be arranged on a single 40"×48" pallet with one discharge valve in each corner. Thus, all four bins can be emptied without having to move the pallet.

In addition, the commercially developed 55 gallon bins have been laboratory tested and have been used to ship products several thousand miles. The blanks for outer sleeve 20 and inner sleeve 40 can be constructed from two-ply 40 lb board. The blank for inner sleeve 40 is provided with an interior coating of Michelman 50 H moisture barrier except were the glue tabs meet. Reinforcement bands 45 and 46 consist of "Sesame tape plus". The blank for outer sleeve 20 may optionally be provided with Michelman 50 H moisture barrier and "Sesame tape plus" reinforcement bands.

While only a single embodiment of the present invention has been shown and described, it is to be understood that many changes and modifications may be made thereunto without departing from the spirit and scope of the invention as defined in the appended claims.

What is claimed is:

1. A container for storing material having a top and a bottom, comprising:

an outer shell having a plurality of shell panels;

a liner disposed within said outer shell and including an inner sleeve and a separate outer sleeve having substantially the same configuration as said inner sleeve, said inner sleeve and said outer sleeve each including main liner panels contiguous with said shell panels and a secondary liner panel, each secondary liner panel being angularly disposed in relation to said main liner panels and said shell panels to form an elongated space, the elongated space having a triangular cross section and being bordered by said outer sleeve secondary liner panel and two adjacent shell panels, said inner sleeve including an opening with a base bordering the opening;

at least one reinforcing band coupled to said liner;

a material storing bladder disposed within said liner for storing material, said material storing bladder including a discharge valve with a throat having opposite ends, a first collar disposed at one end of said throat and a second collar disposed at the opposite end of said throat, said throat being (i) supported by said base, with said inner sleeve being located adjacent one of said collars; p2 (ii) located a specified distance from the bottom of the container; and (iii) constrained by said outer sleeve, with said outer sleeve being wedged between said inner sleeve and the other of said collars; and a base panel disposed within said outer shell for supporting said material storing bladder and facilitating removal of the material from said container.

2. The container as claimed in claim 1, wherein said one reinforcing band is coupled to said inner sleeve between the opening and the bottom of the container along said base to further support said discharge valve located in the opening.

3. The container as claimed in claim 1, wherein said one reinforcing band is coupled to said inner sleeve between the opening and the top of the container.

4. The container according to claim 1, wherein each of said main liner panels of said inner sleeve has a top edge, and a foldable top liner flap extending from said top edge adjacent the top of said container.

5. The container according to claim 4, further comprising a substantially rectangular top reinforcement plate located snugly within said container on top of said liner, said top plate having indentations in each of its sides, each of said top liner flaps extending through a corresponding one of said indentations and being folded toward another opposite one of said top liner flaps on top of said top plate.

6. The container according to claim 5, wherein each of said main liner panels of said inner sleeve has a bottom edge and a foldable bottom liner flap extending from said bottom edge adjacent the bottom of said container.

7. The container according to claim 6, further comprising a substantially rectangular bottom reinforcement plate located snugly within said container underneath said liner, said bottom plate having indentations in each of its sides, each of said bottom liner flaps extending through a corresponding one of said indentations and being folded toward another opposite one of said bottom liner flaps underneath said bottom plate.

8. The container according to claim 7, wherein said elongated space extends between said top plate and said bottom plate and has a triangular cross section.

9. The container according to claim 1, wherein said outer shell includes means for accessing said discharge means.

10. The container according to claim 8, wherein said base panel comprises a plurality of layers located between said bottom plate and said bottom flaps, whereby said discharge value is spaced from said container bottom and is thereby more easily accessible.

* * * * *